US005795170A

United States Patent [19]

Okabe

[11] Patent Number: 5,795,170

[45] Date of Patent: Aug. 18, 1998

[54] FEMALE TERMINAL FOR WATERPROOF CONNECTOR AND RESIN-FILLED WATERPROOF CONNECTOR

[75] Inventor: Toshiaki Okabe, Haibara-gun, Japan

[73] Assignee: Yazaki Corporation, Tokyo, Japan

[21] Appl. No.: 728,369

[22] Filed: Oct. 10, 1996

[30] Foreign Application Priority Data

Oct. 13, 1995 [JP] Japan ..... 7-265363

[51] Int. Cl.[6] ..... H01R 11/22

[52] U.S. Cl. ..... 439/252; 439/936

[58] Field of Search ..... 439/852, 936, 439/276, 252, 246, 736, 204, 851, 948

[56] References Cited

U.S. PATENT DOCUMENTS

| | | | |
|---|---|---|---|
| 3,252,126 | 5/1966 | Brown | 439/417 |
| 4,131,331 | 12/1978 | Kendall, Jr. | 439/559 |
| 4,274,701 | 6/1981 | Bannert et al. | 439/246 |
| 4,778,404 | 10/1988 | Pass | 439/948 |
| 4,838,816 | 6/1989 | Matsusaka et al. | 439/852 |
| 5,000,695 | 3/1991 | Nishiyama et al. | 439/276 |
| 5,211,587 | 5/1993 | Alden | 439/852 |

*Primary Examiner*—Neil Abrams
*Assistant Examiner*—Tho Dac Ta
*Attorney, Agent, or Firm*—Armstrong, Westerman, Hattori, McLeland & Naughton

[57] ABSTRACT

A female terminal for waterproof connector which is so filled with resin-material that water or the like can not permeate the inside of a terminal receiving chamber of a connector housing, and a resin-filled waterproof connector which is inserted into the waterproof connector so that it prevents an outflow of the resin-material toward an electric contacting section. The female terminal includes the electrical contacting section 6 with a contacting spring piece 12, and the electrical wire connected section following the electrical contacting section, in order to prevent the resin material from outflow toward the side of electrical contacting section 6, the closed section which blocks the terminal receiving chamber 4a of the connector housing 2 containing the female terminal is formed between the electrical contacting section and the electrical wire connected section 8. The closed section 7 is so integrally formed that it becomes box-shape. A resilient section 9 intervenes between the electrical contacting section 6 and the closed section 7 so that it causes the electrical contacting section to move within the terminal receiving chamber 4a. The resilient section 9 is a bent section formed on the terminal substrate. A resin-filled waterproof connector consists of the above described female terminal for waterproof connector.

9 Claims, 2 Drawing Sheets

FEMALE TERMINAL FOR WATERPROOF CONNECTOR AND RESIN-FILLED WATERPROOF CONNECTOR

BACKGROUND OF THE INVENTION

1. Field of the Invention

The present invention relates to a resin-filled waterproof connector which is so filled with resin-material that water, or the like, cannot permeate the inside of a terminal receiving chamber of a connector housing, and to a female terminal for a waterproof connector which is inserted into the waterproof connector so that it prevents an outflow of the resin-material toward an electrical contacting section.

2. Description of the Prior Art

FIGS. 4 and 5 show a conventional resin-filled waterproof connector.

The resin-filled waterproof connector 31 comprises a connector housing 32 made of synthetic resin, a male tab terminal 35 clamped to an electrical wire 34, which is mounted in a terminal-receiving chamber 33 of the connector housing 32, a resin material 36 for waterproofing purposes being filled in the terminal-receiving chamber 33 after inserting the male tab terminal 35.

As shown in FIG. 5, the male tab terminal 35 comprises a plate-shaped tab section 37, and an electrical wire clamping section 38 following the tab section 37. The tab section 37 has a pair of projections 39 on both sides of an intermediate portion thereof. Slender male tab insertion holes 42 are formed in a partition wall 41 separating the terminal-receiving chamber 33 of the connector housing 32 from an engaging chamber 40 corresponding to the other female terminal (not shown). The male tab terminal 35 is so fixed without looseness that the pointed end portion of the tab section 37 is inserted into the male tab insertion hole 42 and the projections 39 are pressed to be wedgedly inserted into the hole. The pointed end portion of the tab section 37 is positioned to project into the engaging chamber 40.

Subsequently, as shown in FIG. 4, the terminal-receiving chamber is filled with melted resin material 36, which is cooled to be solidified, so that both the terminal receiving chamber 33 at the side of electrical wire 34 and the engaging chamber 40 housing the pointed end portion of the tab section 37 are isolated airtightly by the resin material 36. By these measures, water drops from the connector housing 32 are prevented from entering the other connector housing, which is not shown.

However, the above described conventional structure of the connecter housing requires that the male tab terminal 35 be forced into, and fixed to, the partition wall 41 of the connector housing 32 so that the resin material 36, for waterproofing does not flow out toward the engaging chamber 40 into which the other side female terminal; namely, the pointed end portion of the tab section 37 of the male tab terminal 35, enters. The above waterproof structure is incapable of being formed in the female terminal (not shown) instead of the male tab terminal 35. Namely, even if the female terminal is forced into the insertion hole 42 of the partition wall 41, the airtightness cannot be secured because of the clearance which exits at the inside of the female terminal. Furthermore, in order to make certain of fixing a bent portion of a contacting spring piece corresponding to the other side male terminal, the female terminal should be inserted into the terminal-receiving chamber with some extent of looseness, and there is caused a problem that the female terminal is incapable of being forced into, and fixed, in the chamber.

SUMMARY OF THE INVENTION

In view of the foregoing, it is an object of the present invention to provide a female terminal for a waterproof connector in which the structure waterproof by virtue of a resin-filled connector for the female terminal.

According to one aspect of the present invention, for achieving the above-mentioned objects, there is provided a female terminal for a waterproof connector which comprises an electrical contacting section having a contacting spring piece, an electrical wire-connected section following the electrical contacting section, a female terminal including the electrical contacting section and the electrical wire-connected section, and a closed section formed between the electrical contacting section and the electrical wire-connected section for blocking a terminal-receiving chamber of a connector housing containing the female terminal, wherein, when resin material for waterproofing purposes is filled into the terminal-receiving chamber of the electrical wire-connected section, outflow of resin material from the side of electrical contacting sections is prevented.

In a female terminal for a waterproof connector, the closed section comprises side walls which are bent upwardly from respective sides of a terminal substrate section, front and rear walls which are bent laterally from said respective side walls, and a top wall which is bent from one of the side walls, so that the closed section is formed in the shape of a box.

A female terminal for a waterproof connector further comprises a resilient section which intervenes between the electrical contacting section and the closed section so that the electrical contacting section is permitted to move within the terminal-receiving chamber.

Furthermore, in a female terminal for a waterproof connector, the resilient section is a bent section formed on the terminal substrate.

Moreover, a resin-filled waterproof connector comprises a female terminal for a waterproof connector which corresponds to the above-described respective female connectors.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

DETAILED DESCRIPTION OF THE PREFERRED EMBODIMENTS

A preferred embodiment of the invention will now be described in detail referring to the accompanying drawings.

Figure 1:
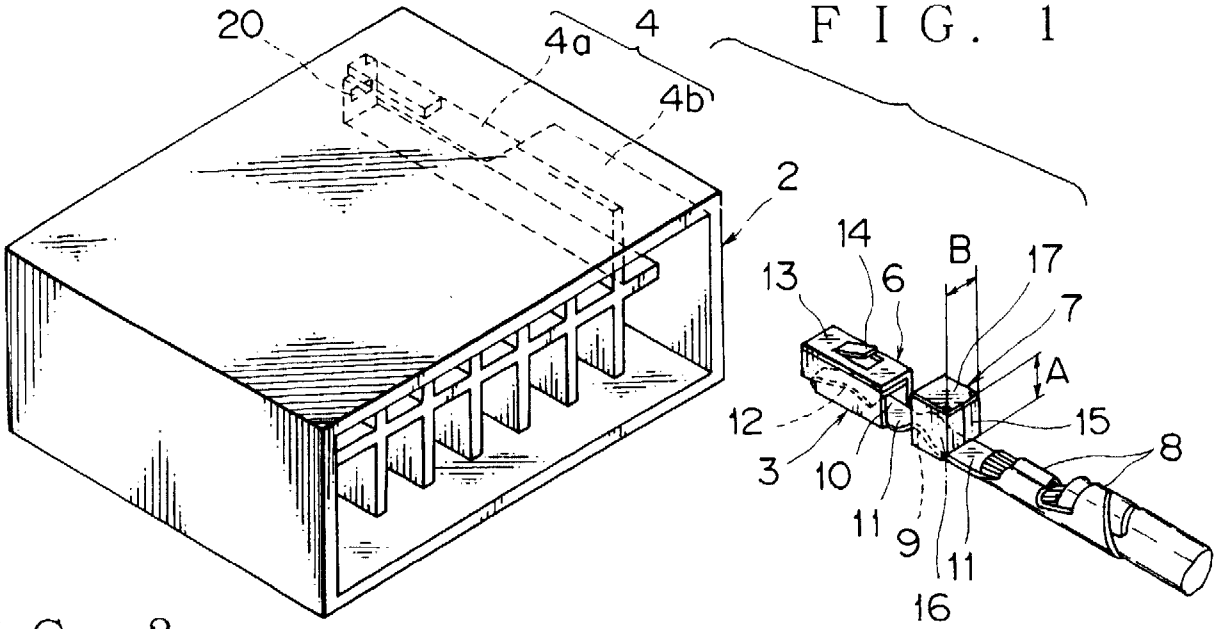
FIG. 1 is an exploded perspective view showing a resin-filled waterproof connector using a female terminal for the connector according to the present invention.
Figure 3:
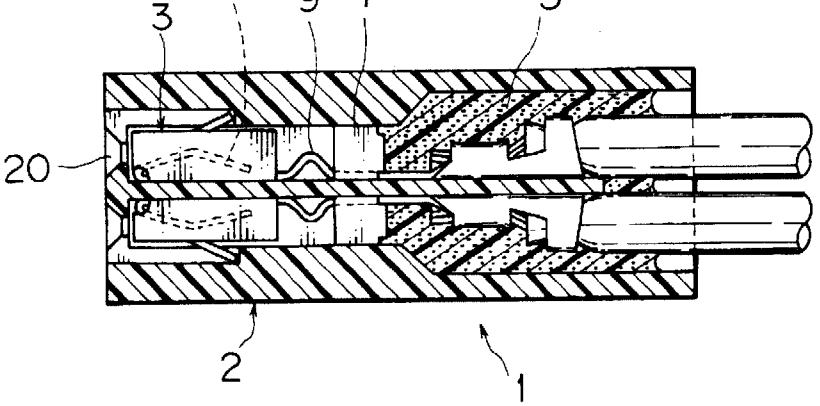
FIG. 3 is a vertical section similar to FIG. 2 showing the connector in a filled condition with a waterproof resin to an electrical wire connecting part.
Figure 2:
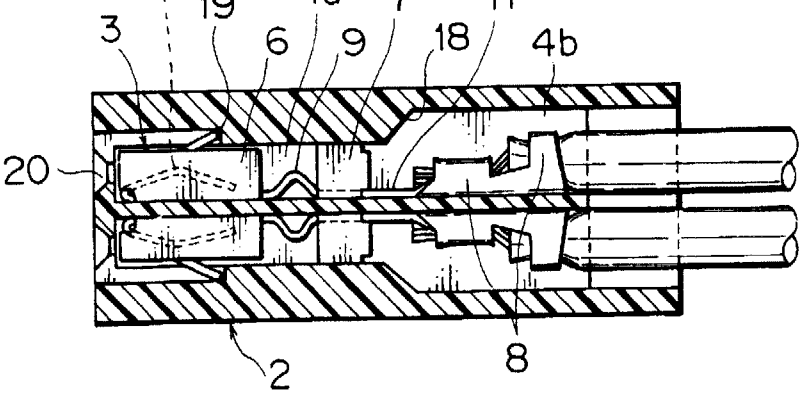
FIG. 2 is a vertical section showing a mounted condition of the female terminal for within the waterproof connector housing.
Figure 4:
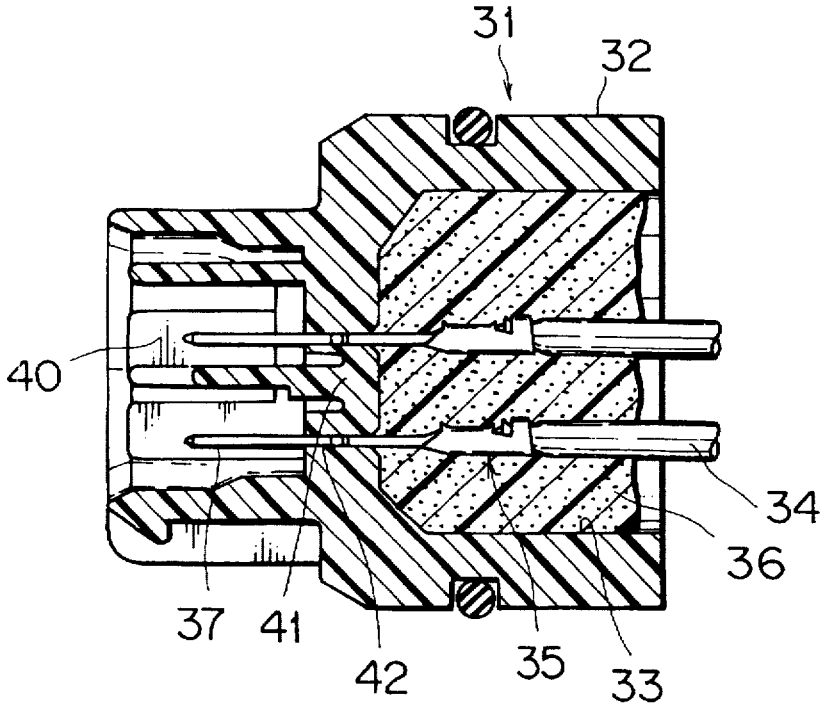
FIG. 4 PRIOR ART
FIG. 4 is a vertical section showing a conventional resin-filled waterproof connector.
Figure 5:
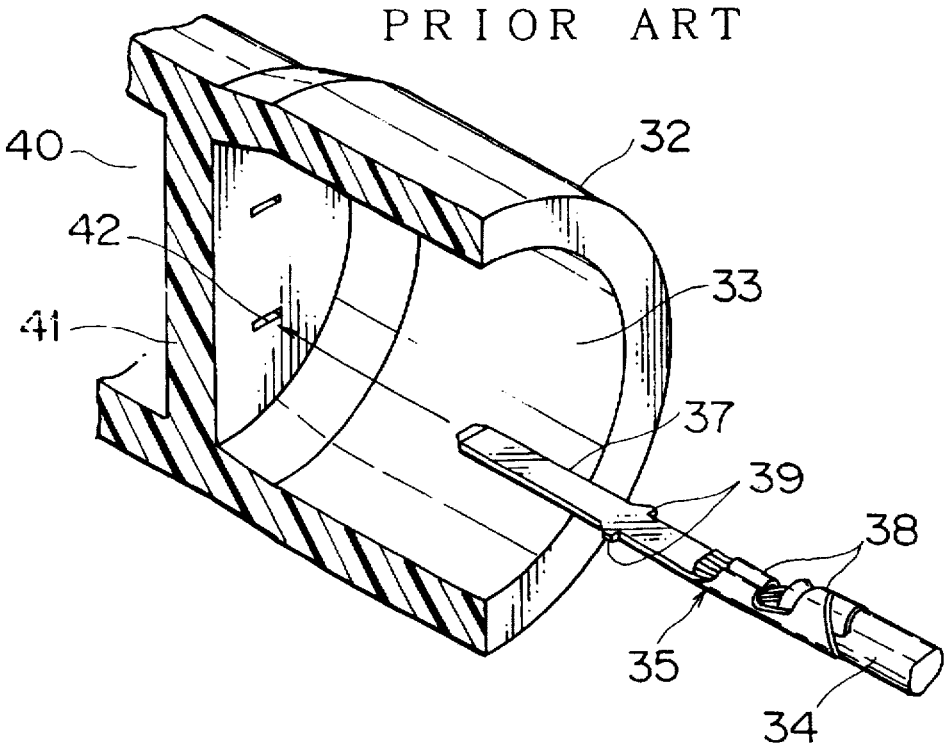
FIG. 5 PRIOR ART
FIG. 5 is an exploded perspective view showing a mounting condition of a male tab terminal to a connector housing.

FIGS. 1 to 3 show a resin-filled waterproof connector according to the present invention.

The resin-filled waterproof connector 1 comprises a connector housing 2 made of synthetic resin, a female terminal 3 for a waterproof connector for mounting on the inside of the connector housing 2, a resin material 5 (referring to FIG. 3) for waterproofing purpose which is filled in the rearward part 4*b* of a terminal receiving chamber 4 of the connector housing 2, after insertion of the female terminal 3.

The female terminal 3 for the waterproof purpose connector comprises an electrical contacting section 6 whose shape is as a rectangular pipe (box-shape), as shown in FIG. 1. A closed rectangular wall section 7 follows the electrical contacting section 6, and an electrical wire clamping section (an electrical wire connecting section) 8 follows the closed wall section. The electrical contacting section 6 is coupled to the closed wall section 7 by a flexible section (bendable section) 9. The flexible section (bendable section) 9 is formed on a terminal substrate section 11 which is formed in such a way that a bottom board section 10 of the electrical contacting section 6 is extended rearward. The substrate section 11 is extended to the rear part of the flexible section 9. The closed wall section 7 and the electrical wire clamping section 8 are bent upwardly from the substrate section 11.

A contacting spring piece 12 is so formed that it is offset upwardly above the bottom board section 10 within the electrical contacting section 6. A resilient locking piece 14 for cooperating with the connector housing 2 is cut and raised a top board 13 opposite to the bottom board section 10. Since the resilient section 9 is bent in the rising direction of the contacting spring piece 14, it can cause the electrical contacting section 6 to displace freely in the up and down direction; namely, in the bending direction of the contacting spring piece 12. Alternatively, the shape of the resilient section 9 may also be of wave-shape rather than generally conical-shape to permit, the resilient section 9 in which it permits a degree of freedom in the longitudinal direction and/or lateral direction, particularly, a degree of freedom in the bending direction of the contacting spring piece 12 can be employed to cooperate with the electrical contacting section 6.

As shown the extent of longitudinal dimension A and of lateral dimension B are established in the closed wall section 7 to be greater than the corresponding dimensions of the electrical contacting section 6. The closed wall section 7, which has front and rear walls 15, right and left side and delete walls 16 (both sides), and a top wall 17, is formed in the shape of a box whose periphery portion is covered by closed walls. The closed wall section 7 should be inserted into the terminal-receiving chamber 4*a* of the connector housing 2 without looseness. Therefore, an area of the front and rear walls 15 (front wall is not illustrated) or of the rear wall 15; namely, the longitudinal dimension A and the lateral dimension B, should be nearly equal in cross sectional area to that of the terminal receiving chamber 4*a*. In the strict sense of the word, the longitudinal dimension A and the lateral dimension B are established to define a slightly smaller dimension than corresponding dimensions of the terminal-receiving chamber 4*a* in such a manner that the closed wall section 7 can be inserted slidably into the terminal-receiving chamber 4*a*. The electrical contacting section 6 is made similarly smaller than the terminal-receiving chamber 4*a* so that the electrical contacting section 6 is accommodated within the terminal receiving chamber 4*a* with some extent of looseness in the longitudinal and lateral directions.

In the described embodiment, side walls 16 of the closed wall section 7 are formed integrally with the substrate 11 in such a way that the side walls 16 are bent upwardly from the substrate 11. The front and rear walls 15 is formed integrally with the side wall 16 in such a way that the front and rear walls 15 are bent from the side wall 16. The top wall 17 is formed integrally with the front wall or the side wall 16 in such a way that the top wall 17 is bent from the front wall or the side wall 16. Even if there is no front wall, a closed condition exists, however if there exists the front wall, the strength of the structure increases whereby, the stability of insertion or extraction of the covered wall section 7 is improved.

As shown in FIG. 2, in the terminal-receiving chamber 4 of the connector housing 2, the rear portion 4*b* is more extensive than the front portion 4*a*. The electrical contacting section 6 of the female terminal 3 and the closed wall section 7 are accommodated within the front portion 4*a*, and the electrical wire clamping section 8 is accommodated within the rear portion 4*b*. A tapered guide surface 18 from the rear portion 4*b* of the terminal-receiving chamber 4 is formed at the entrance side of the front portion 4*a* of the terminal receiving chamber 4, so that the electrical contacting section 6 and the closed wall section 7 are guided smoothly along the tapered guide surface 18. The electrical contacting section 6 is sited at the inside of the front portion 4*a* of the terminal-receiving chamber 4 with some extent of looseness. The closed wall section 7 is closely held without clearance at the entrance side of the front portion 4*a* of the terminal-receiving chamber 4. Further, the female terminal 3 is prevented from coming off rearwardly by the fact that the resilient locking piece 14 engages with a step section 19 formed on the front portion 4*a* of the terminal-receiving chamber 4.

As shown in FIG. 3, when melted resin material 5 for waterproofing purposes is filled in the rear portion 4*b* of the terminal-receiving chamber 4, the closed wall section 7 securely inhibits the resin material 5 from flowing into the front portion 4*a* of the terminal-receiving chamber 4. Further, the electrical contacting section 6 is shiftable in the longitudinal direction or lateral direction within the front portion 4*a* of the terminal-receiving chamber 4 due to the resilient section ( bendable section ) 9 of the female terminal 3.

For this reason, in case of the engagement between connectors, the pointed end tab section of the male tab terminal of the other connector, which is not illustrated, is inserted into the electrical contacting section 6 of the female terminal 3 from the front opening 20 of the connector housing 2. Even if the contacting spring piece 12 within the electrical contacting section 6 is bent excessively in the longitudinal direction (perpendicularly to the tab section ) by the fact that the contacting spring piece 12 is pressed by the pointed end tab section, since the electrical contacting section 6 is displaced in the pressing direction within the terminal-receiving chamber, the contacting spring piece 12 comes into contact with the pointed end tab section with fixed deflection, so that secure electrical contact is attained with appropriate contacting pressure.

Further, it is suitable that, if the contacting spring piece 12 is also glasses-shape, the box-shape electrical contacting section need not be employed, because the electrical contacting section is made to comprise a contacting spring piece and the bottom board section (10 in FIG. 1).

As described above, according to the present invention, since the closed section of the female terminal blocks the intermediate region of the terminal-receiving chamber of the connector housing, molten resin material filled in the side of electrical wire-connected section of the terminal-receiving chamber does not escape toward the electrical contacting section. Further, even if the female terminal is fixed to the terminal-receiving chamber at the closed section, since the electrical contacting section is supported shiftably by the resilient section, the contacting pressure between the female terminal and the male tab terminal of the other connector is always made certain to be of fixed value.

For this reason, in the resin-filled type waterproof connector, although a female terminal is employed, a secure waterproofing property and electrical connectivity are capable of being obtained.

While preferred embodiments of the invention have been described using specific terms, such description is for illustrative purpose only, and it is to be understood that changes and variations may be made without departing from the spirit or scope of the following claims.

What is claimed is:

1. A female terminal for a waterproof connector comprising, in integrally formed relation:

an electrical contacting section having a contacting spring piece;

an electrical wire-connected section formed adjacent said electrical contacting section; and a closed section formed between said electrical contacting section and said electrical wire-connected section for blocking a terminal-receiving chamber of a connector housing containing said female terminal, wherein, when resin material for waterproofing fills that portion of said terminal-receiving chamber containing said electrical wire connected section, passage of said resin material to the electrical contacting section side of said closed section of said terminal is prevented and wherein said closed section is in the shape of a box and is formed integrally with a terminal substrate section of the terminal.

2. A female terminal for a waterproof connector according to claim 1, wherein said closed section comprises oppositely spaced side walls which are bent upwardly from a surface of a terminal substrate section, front and rear walls which are bent laterally from each of said side walls, and a top wall which is bent from one of said walls, so that said closed section is formed in the shape of a box.

3. A female terminal for a waterproof connector according to claim 1, in which said connector includes a terminal-receiving chamber and wherein said electrical contacting section of said female terminal and said closed section are accommodated within a front portion of said terminal-receiving chamber, and said electrical wire-connecting section is accommodated within a rear portion of said terminal-receiving chamber which is more extensive than said front portion.

4. A female terminal for a waterproof connector according to claim 3, wherein said electrical contacting section is disposed within said front portion of said terminal-receiving chamber with some extent of looseness, and said closed section is received substantially without clearance adjacent an entrance of said front portion of said terminal-receiving chamber.

5. A female terminal for a waterproof connector according to claim 1, including a resilient locking piece extending from said terminal for engaging said terminal-receiving chamber to prevent detachment of said terminal from said chamber.

6. A female terminal for a waterproof connector according to either one of claim 1 or claim 2, further comprising a flexible section disposed between said electrical contacting section and said closed section to permit said electrical contacting section to move within a front portion of said terminal-receiving chamber.

7. A female terminal for a waterproof connector according to claim 6, wherein said flexible section is a bent portion formed on said terminal substrate.

8. A resin-filled waterproof connector comprising:

a connector housing made of synthetic resin and having walls forming a terminal-receiving chamber;

a female terminal mounted within said terminal-receiving chamber of said connector housing, said female terminal integrally containing a closed section in tightly fit relation with respect to said walls of said terminal-receiving chamber and dividing said chamber into a front portion and a rear portion; and a monolithic resin material for waterproofing, filling said rear portion of said terminal-receiving chamber of said connector housing about said female terminal, wherein said closed section prevents said water proofing resin material from entering said front portion of said terminal-receiving chamber.

9. A resin-filled waterproof connector according to claim 8, wherein a female terminal for waterproof connector is employed, which corresponds to any of claims 1, 2, 3, 4 or 5.

* * * * *